US006494731B1

(12) United States Patent
Suzuki

(10) Patent No.: US 6,494,731 B1
(45) Date of Patent: Dec. 17, 2002

(54) WATERPROOF CONNECTOR

(75) Inventor: Shogo Suzuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/590,072

(22) Filed: Jun. 9, 2000

(30) Foreign Application Priority Data

Jun. 28, 1999 (JP) ..... 11-182067

(51) Int. Cl.[7] ..... H01R 13/52
(52) U.S. Cl. ..... 439/275; 439/71; 439/587
(58) Field of Search ..... 439/190, 587, 439/589, 230, 275, 588, 595, 600, 601, 603

(56) References Cited

U.S. PATENT DOCUMENTS

| | | | | |
|---|---|---|---|---|
| 4,713,021 A | * | 12/1987 | Kobler | 439/589 |
| 4,776,813 A | * | 10/1988 | Wilson et al. | 439/587 |
| 5,240,433 A | * | 8/1993 | Kato | 439/587 |
| 5,266,045 A | * | 11/1993 | Yamamoto et al. | 439/275 |
| 5,498,170 A | * | 3/1996 | Tanaka | 439/271 |
| 5,709,563 A | * | 1/1998 | Saito | 439/275 |
| 6,179,657 B1 | | 1/2001 | Murakami et al. | 439/587 |
| 6,203,348 B1 | * | 5/2001 | Fukuda | 439/275 |

FOREIGN PATENT DOCUMENTS

| | | | |
|---|---|---|---|
| GB | 2168548 | * 12/1984 | 439/587 |
| JP | 5-6784 | 1/1993 | |
| JP | 8-96883 | 4/1996 | |
| JP | 11-329571 | 11/1999 | |

OTHER PUBLICATIONS

WO92/15133, Fortin Hugues, Electrical Connector with sealing feed–through (PCT) all pages, Sep. 1992.*

* cited by examiner

*Primary Examiner*—Brian Sircus
*Assistant Examiner*—J. F. Duverne
(74) *Attorney, Agent, or Firm*—Morgan, Lewis & Bockius LLP

(57) ABSTRACT

A connector housing includes a terminal chamber for accommodating a terminal to which an electric wire is connected. A rear holder is attached to a rear end portion of the connector housing. A waterproof rubber plug has a through hole through which the electric wire is inserted. One end of the rubber plug is configured as a cylindrical sealing portion. The other end of the rubber plug is configured as a proximal end portion integrally provided with a rear end wall of the rear holder. A plug chamber is formed in the rear end portion of the connector housing so as to communicate with the terminal chamber for accommodating the rubber plug therein when the rear holder is attached with the connector housing. The dimension of the plug chamber is determined such that the sealing portion of the rubber plug is accommodated while being compressed by an inner wall of the plug chamber during the attaching operation of the rear holder.

3 Claims, 11 Drawing Sheets

WATERPROOF CONNECTOR

BACKGROUND OF THE INVENTION

This invention relates to a small size multi-way waterproof connector in which a waterproof seal between a connector housing and a plurality of wires, each connected to a terminal, is enhanced.

A related waterproof connector, which is disclosed in Japanese Patent Publication No. 11-329571A, will now be described specifically with reference to FIGS. 6 to 8. A connector housing 11 of the waterproof connector 10 includes an inner housing 12, which is integrally molded of synthetic resin, and has a plurality of terminal chambers 13, an outer housing 17 of synthetic resin, in which the inner housing 12 is fitted, and a spacer 28 of synthetic resin which is provided between the inner housing 12 and the outer housing 17 to retain female terminals 14

As shown in FIGS. 6 and 7, the inner housing 12 has a box-like body 12*a*, and upper and lower sides of this box-like body 12*a* are open at a rear portion thereof. The terminal chambers 13 are formed by a central horizontal wall 12*b* and upper and lower vertical side walls (serving as partition walls) 12*c*. The female terminals 14 ale adapted to be received in the terminal chambers 13, respectively. Retaining pawls 15 are integrally formed respectively on opposite side portions and a central portion of each of the upper and lower faces of the body 12*a*. Insertion holes 12*d* of a rectangular shape are formed respectively through those portions of a front wall of the body 12*a* opposed respectively to the terminal chambers 13, and male terminals in a mating connector (not shown) are passed through these insertion holes 12*d*, respectively. Two pairs of press connecting blades 14*b* are formed by stamping on opposite side walls of a box-like portion 14*a* of the female terminal 14 at a rear portion thereof.

As shown in FIGS. 6 and 7, the outer housing 17 includes an inner wall portion 17*a* of a substantially square tubular shape, an outer wall portion 17*b* of a substantially square tubular shape formed around the inner wall portion 17*a*, and a bottom wall portion 17*c* interconnecting rear end portions of the inner and outer wall portions 17*a* and 17*b*. Thus, the outer housing 17 has a double-wall box 2 shaped construction having an open front side. A central portion of the bottom wall portion 17*c* is thickened, and rubber plug chambers or recesses 19 of a circular cross-section With a large diameter are formed respectively in those portions of an inner face of this thickened portion opposed respectively to the terminal chambers 13, and waterproof rubber plugs 18 are inserted respectively into these rubber plug chambers 19 by press-fitting or the like. Wire insertion holes 21 of a circular cross-section with a smaller diameter are formed in the outer face of the thickened portion, and communicate with the rubber plug chambers 19, respectively, and wires 20 are passed through the wire insertion holes 21, respectively. The waterproof rubber plug 18 has corrugated, cylindrical inner and outer peripheral faces, and the wire 20 is passed through the bore of the rubber plug 18, with no gap formed therebetween.

Retaining hole of a rectangular shape are formed respectively in opposite side portions o a front portion of each of upper and lower walls of the inner wall portion 17*a* of the outer housing 17, and the retaining pawls 15, formed respectively on the opposite side portions of the upper and lower faces of the body 12*a* of the inner housing 12, are releasably engaged in these retaining holes 22, respectively. A rectangular longitudinal retaining hole 23 is formed in a central portion of the front portion of each of the upper and lower walls of the inner wall portion 17*a*, and the retaining pawls 15, formed respectively on the central portions of the upper and lower faces of the body 12*a* of the inner housing 12, are releasably engaged in these retaining holes 23, respectively. A V-shaped packing-receiving part 25 for receiving an annular waterproof packing 24 of rubber is formed integrally on the outer face of the inner wall portion 17*a* of the outer housing 17 at the inner end portion thereof. Those portions of the inner face of the inner wall portion 17*a* of the outer housing 17, disposed immediately adjacent respectively to front edges of the retaining holes 22 and 23, are formed respectively into tapered faces 26. Retaining holes 27 are formed respectively in upper and lower walls the outer wall portion 17*b* of the outer housing 17, and elastic retaining arms of the mating connector (not shown) are releasably engaged in these retaining holes 27, respectively.

As shown in FIGS. 6 and 7, the spacer 28 includes a body 28*a* of a substantially square tubular shape for fitting in the inner wall portion 17*a* of the outer housing 17, a flange portion 28*b* of a substantially square tubular shape, integrally formed on and extending in a stepped manner rearwardly from a front end of the body 28*a* so a to fit on the inner wall portion 17*a* of the outer housing 17, and a bottom wall portion 28*c* closing a rear end of the body 28*a*. Thus, the spacer 28 has a box-like shape having an open front end.

The body 12*a* of the inner housing 12 is fitted into the tubular body 28*a* of the spacer 28. Rib-like projections 29 for preventing disengagement of the terminals are formed integrally on inner faces of upper and lower walls of the body 28*a* of the spacer 28, and these projections 29 serve to retain the rear edge of the body 12*a* of the inner housing 12, and also serve to retain the rear edges of the box-like portions 14*a* of the female terminals 14, received respectively in the terminal chambers 13, respectively.

Notches 30 are formed respectively in those portions of an interconnecting portion (which interconnects the body 28*a* and the flange portion 28*b* of the spacer 28), corresponding respectively to the retaining pawls 15 on the inner housing 12, and also notches 31 are formed respectively in those portion of this interconnecting portion corresponding respectively to flanges 16 formed on the inner housing 12. A retaining pawl 32 is formed integrally on the outer face of each of the upper and lower walls of the body 28*a* of the spacer 28, and is disposed between the upper or lower) notches 30, and these retaining pawls 32 are releasably engages respectively in the retaining holes 23 in the outer housing 17. When the spacer 28 is completely fitted into the outer housing 17, the distal end of the flange portion 28*a* of the spacer 28 serves to hold the packing 24 retained on the packing-receiving part 25 on the inner wall portion 17*a* of the outer housing 17.

Wire insertion holes 33 are formed respectively through those portions of the bottom wall portion 28*c* of the spacer 28 corresponding respectively to the wire insertion holes 21 in the outer housing 17. When the spacer 28 is completely fitted into outer housing 17, the bottom wall portion 28*c* of the spacer 28 serves to hold the rubber plugs 18 inserted respectively in the rubber plug chambers 19 in the bottom wall portion 17*c* of the outer housing 17. As shown in FIG. 6, the wires 20 are passed respectively through the wire insertion holes 21 in the outer housing 17, the rubber plugs 18 and the wire insertion holes 33 in the spacer 28, a d each wire 20 is press-fitted into a space between each pair of press-connecting blades 14*b* of the female terminal 14 received in the associated terminal chamber 13, and the terminal chambers 13 and the wires 20 are sealed by the rubber plugs 18 and the packing 24.

For assembling the waterproof connector 10 of the above construction, the rubber plugs 18 are inserted respectively into the rubber plug chambers 19, formed in the inner face of the bottom wall portion 17*c* of the outer housing 17 (which forms the outer portion of the connector housing 11), and also the packing 24 is fitted in the packing-receiving part 25 on the inner wall portion 17*a* of the outer housing 17, as shown in FIG. 8A.

Then, the body 28*a* of the spacer 28 is fitted into the inner wall portion 17*a* of the outer housing 17 as shown in FIG. 8B, so that the retaining pawls 32 on the body 28*a* of the spacer 28 are retaining engaged respectively in the retaining holes 23 in the inner wall portion 17*a* of the outer housing 17. As a result of the retaining engagement of the retaining pawls 32 (formed on the body 28*a* of the spacer 28) in he respective retaining holes 23 formed in the inner wall portion 17*a* of the outer housing 17, the rubber plugs 18 are retained against withdrawal by the bottom wall portion 17*c* of the outer housing 17, and also the packing 24 is retained against withdrawal by the slanting distal end of the flange portion 28*b* of the spacer 28, and therefore the waterproof ability of the connector housing is further enhanced.

Then, the wires,, 20 are passed through the respective wire insertion holes 21 in the bottom wall portion 17*c* of the outer housing 17 from the outer side thereof, the respective rubber plugs 18 and the respective wire insertion holes 33 in the bottom wall portion 28*c* of the spacer 28, as shown in FIG. 8C. Then, each wire 20 is press-connected to the pairs of press-connecting blades 14*b* of the female terminal 14 received in the associated terminal chamber 13 in the inner housing 12 (which forms the inner portion of the connector housing 11), as shown in FIG. 8D.

Then, the inner housing 12 is fitted into the body 28*a* of the spacer 28 as shown in FIG. 8E, so that the retaining pawls 15 on the body 12*a* of the inner housing 12 are retaining engaged respectively in the retaining holes 23 in the inner wall portion 17*a* of the outer housing 17, thus completing the assembling operation of the waterproof connector 10. At this time, the rear edge of the body 12*a* of the inner housing 12, as well as the rear edges of the box-like portions 14*a*of the female terminals 14, received respectively in the terminal chambers 13, is locked by the projection 29 formed on the inner faces of the upper and lower walls of the body 28*a* of the spacer 28, and the projections 29 will not be deformed outwardly, and therefore the disengagement of the female terminals 14 from the respective terminal chambers 13 is positively prevented. And besides,. since the retainment of the female terminals 14 and the retainment of the rubber plugs 18 are simultaneously achieved by the spacer 28, it is not necessary to provide any member used exclusively for preventing the withdrawal of the rubber plugs, and therefore the number of the component parts is reduced, thereby reducing the cost. Furthermore, the spacer 28 is retained in a double manner by the retaining engagement of the retaining pawls 32 of the spacer 28 in the respective retaining holds 23 in the outer housing 17 and by the retaining engagement of the retaining pawls 15 of the inner housing 12 in the respective retaining holes 23 in the outer housing 17, and therefore the disengagement of the rubber plugs 18 and the packing 24 is positively prevented, thereby further enhancing the reliability of the waterproof effect.

In the above related waterproof connector 10, however, the rubber plugs 18 are first received respectively in the rubber plug chambers 19 in the outer housing 17 as shown in FIG. 8B, and therefore when passing the wires 20 through the respective wire insertion holes 21 in the outer housing 17 and the respective wire insertion holes 33 in the spacer 28 as shown in FIGS. 8B and 8C and also when fitting the inner housing 12 into the spacer 28, fitted in the outer housing 17 while sliding the wires 21 relative to the wire insertion holes 33 in the spacer 28 and the wire insertion holes 21 in the outer housing 17 as shown in FIGS. 8D and 8E, the wires 20 are liable to be buckled because of the sliding friction between the wires 20 and the rubber plugs 18 as shown in FIG. 9, and this would sometimes affect the production of wire harnesses. Namely, during the wire passing operation for passing the wires 20 and during the housing-fitting operation for fitting the inner housing 12 into the outer housing 17, the operation load due to the sliding Friction between the rubber plugs 18 and the wires 20 increases, which leads to a possibility that the efficiency of the assembling operation of the waterproof connector 10 is lowered.

And besides, the rubber plugs 18 are completely covered with the bottom wall portion 17*c* of the outer housing 17 and a peripheral wall portion 17*d* around the rubber plug chambers 19, and therefore during the assembling operation of the waterproof connector 10, it was difficult to confirm from the outer side of the outer housing 17 whether or not the rubber plug 18 was received in each rubber plug chamber 19.

SUMMARY OF THE INVENTION

The present invention has been made in order to solve the above problems, and an object of the invention is to provide a small-size multi-way waterproof connector, as well as a method of assembling the same, in which the efficiency of an assembling operation is enhanced.

In order to achieve the above objects, according to the present invention, there is provided a waterproof connector comprising:

- a connector housing including a terminal chamber for accommodating a terminal to which an electric wire is connected;
- a rear holder attached to a rear end portion of the connector housing;
- a waterproof rubber plug having a through hole through which the electric wire is inserted, one end of which is configured as a cylindrical sealing portion, the other end of which is configured as a proximal end portion integrally provided with a rear end wall of the rear holder; and
- a plug chamber formed in the rear end portion of the connector housing so as to communicate with the terminal chamber for accommodating the rubber plug therein when the rear holder is attached with the connector housing,
  - wherein the dimension of the plug chamber is determined such that the sealing portion of the rubber plug is accommodated while being compressed by an inner wall of the plug chamber during the attaching operation of the rear holder.

Preferably, a depth dimension of the plug chamber is determined such that a distal end of the sealing portion of the rubber plug is compressed in the attaching direction of the rear holder when the rear holder is attached with the connector housing.

Since the rubber plug is formed integrally with the rear holder, in the assembling operation in which the wire is passed through the insertion hole of the rubber plug, and then the female terminal is connected to the end portion of the wire, and is received in the terminal chamber in the connector housing, and then the rear holder is fitted into the plug chamber of the connector housing, the insertion resistance bet ween the electric wire and the rubber plug can be efficiently decreased. Thus, the electric wire is prevented from being buckled, thus enhancing the efficiency of the assembling operation of the waterproof connector. Therefore, a wire harness, comprising a bundle of wires, can be easily produced.

And besides, since the sealing portion of the rubber plug is accommodated while being compressed by an inner wall of the plug chamber during the attaching operation of the rear holder, a failure to attach the rubber plug is eliminated, and a, seal between the rubber plug and the plug chamber in the connector housing, as well as a seal between the rubber plug and the wire, can be formed easily and positively, thus enhancing the sealing performance.

Preferably, the dimension of the plug chamber is so determined as to satisfy the following relationship:

$$A<C-B+D$$

where A is an inner diameter of the plug chamber; B is an inner diameter of the through hole of the rubber plug; C is an outer diameter of the sealing portion of the rubber plug; and D is an outer diameter of the electric wire.

Under the above condition, the efficiency of the assembling operation of the waterproof connecter, as well as the waterproof performance thereof, is further enhanced.

Preferably, the connector housing includes a plurality of terminal chambers and the rear holder includes a plurality of waterproof rubber plugs associated with the terminal chambers respectively. The respective proximal ends of the rubber plugs are exposed to an outer face of the rear end wall of the rear holder and connected with each other via a groove formed on the outer face of the rear holder.

Accordingly, the plurality of rubber plugs can be firmly secured to the rear end wall of the rear holder, and the rubber plugs will not be disengaged from the rear holder even when passing the wires respectively through the insertion holes of the rubber plugs. Therefore, the multi-way waterproof connector, having the excellent sealing performance, can be easily assembled in a short. time, and the efficiency of the overall assembling operation can be further enhanced.

DETAILED DESCRIPTION OF THE PREFERRED EMBODIMENTS

One preferred embodiment of the present invention will now be described with reference to the drawings.

Figure 1:
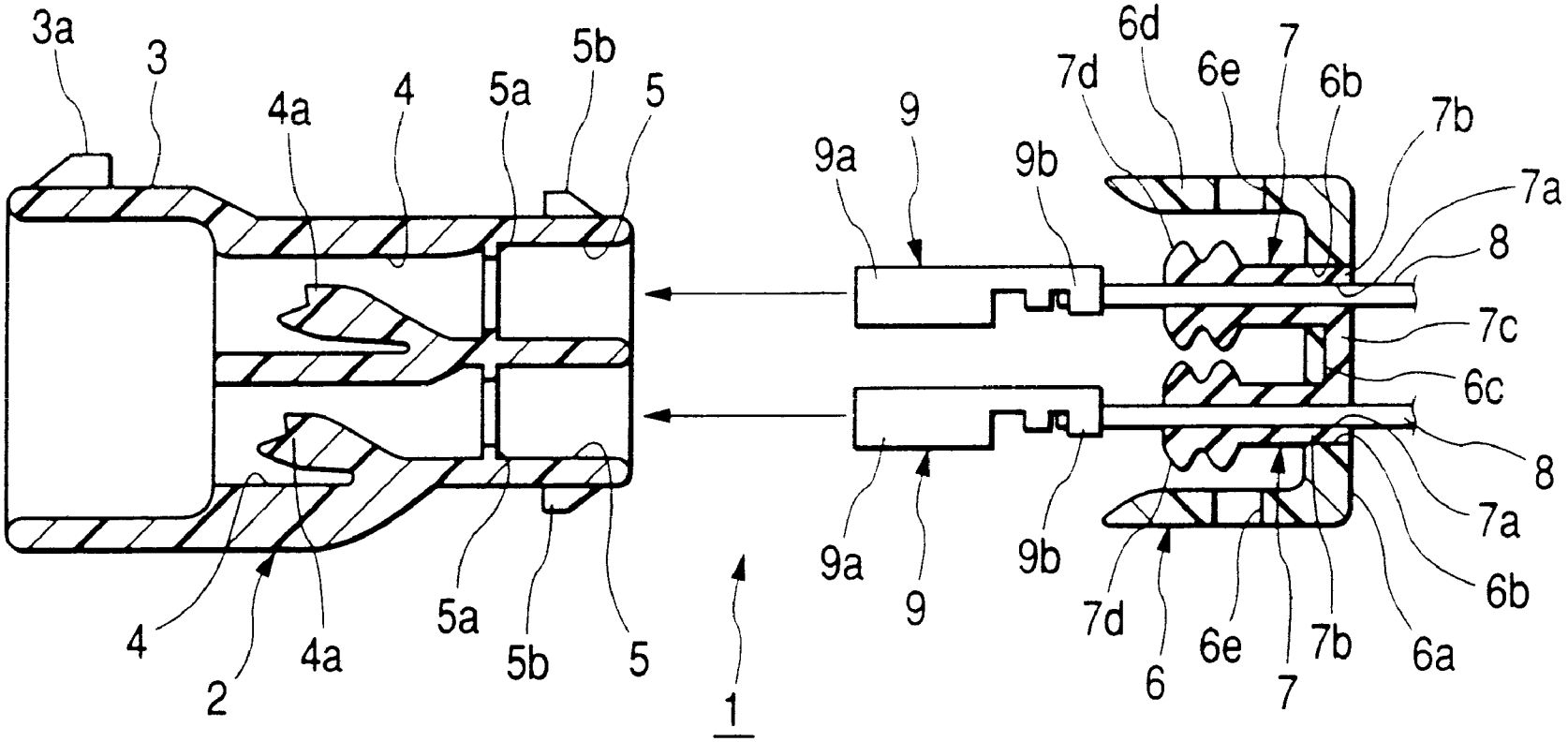
FIG. 1 is a cross-sectional view of one preferred embodiment of a waterproof connector of the invention, showing a state before this connector is assembled.
Figure 2:
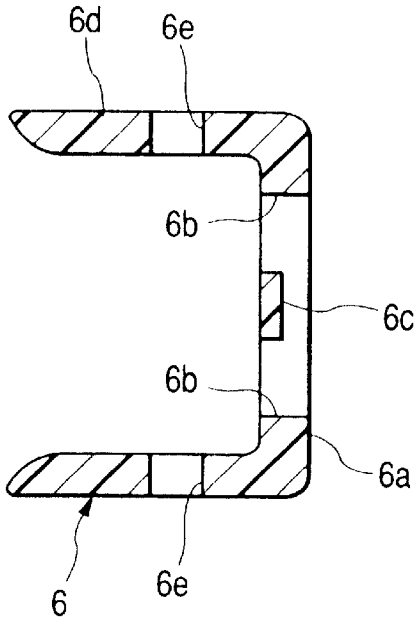
FIG. 2 is a cross-sectional view of a rear holder used in the waterproof connector, showing a state before rubber plugs are integrally molded in the rear holder.
Figure 3:
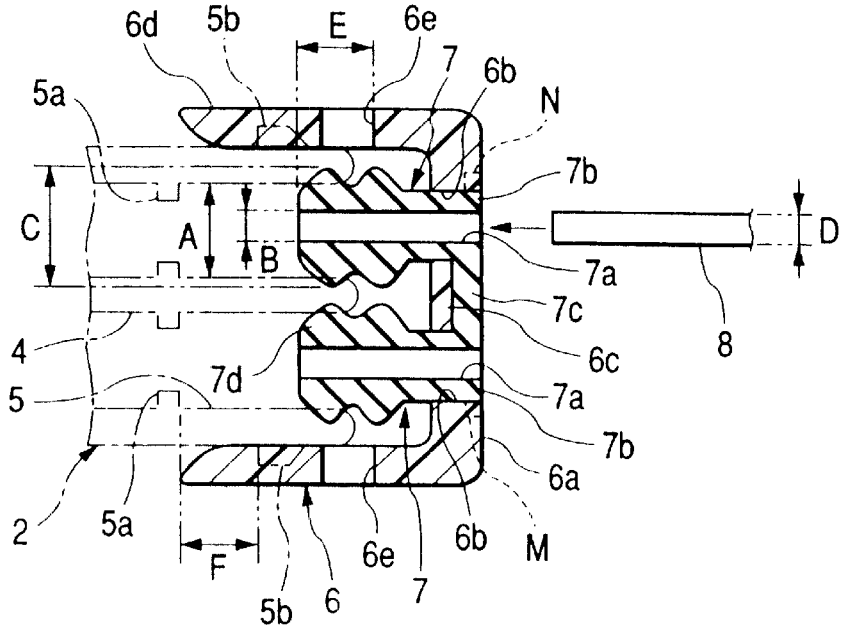
FIG. 3 is a cross-sectional view of the rear holder, showing a state in which the rubber plugs 2 re integrally molded in the rear holder.
Figure 4:
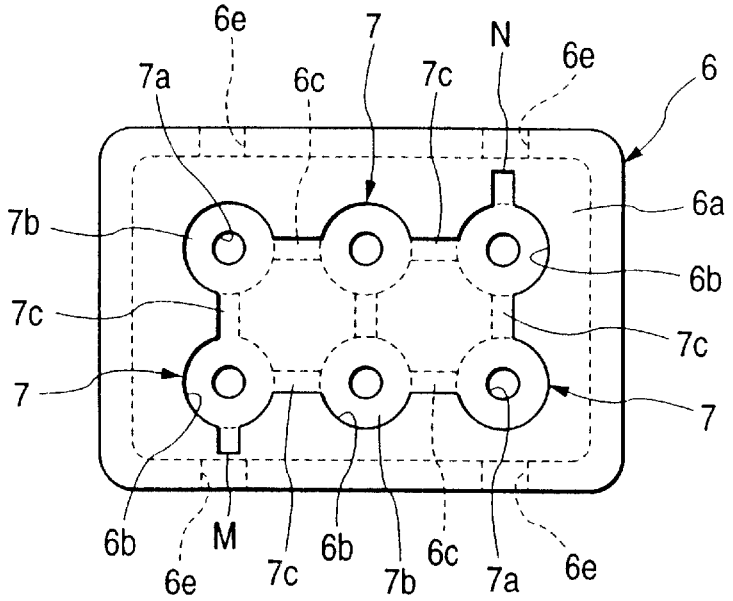
FIG. 4 is a rear view of the rear holder having the rubber plugs integrally molded therein.
Figure 5:
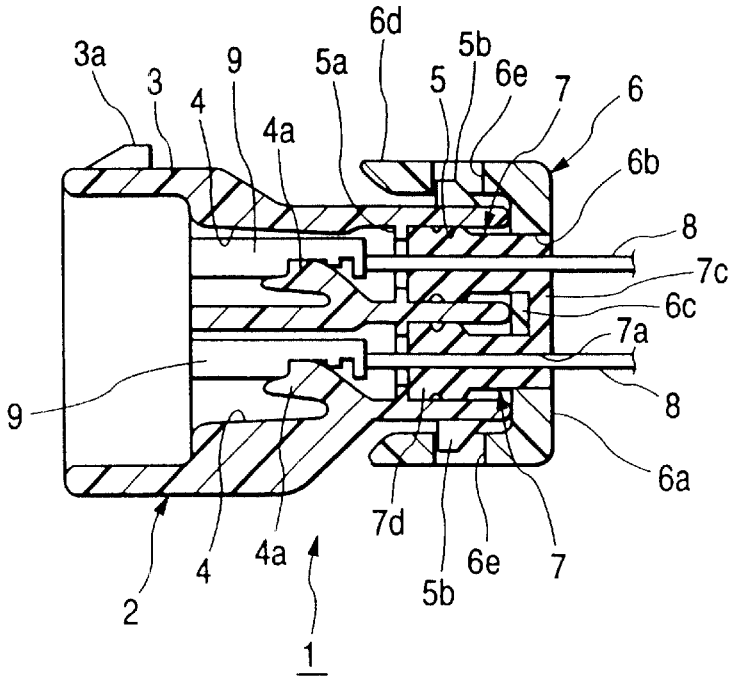
FIG. 5 is a cross-sectional view of the waterproof connector showing a state in which this connector is assembled.
Figure 6:
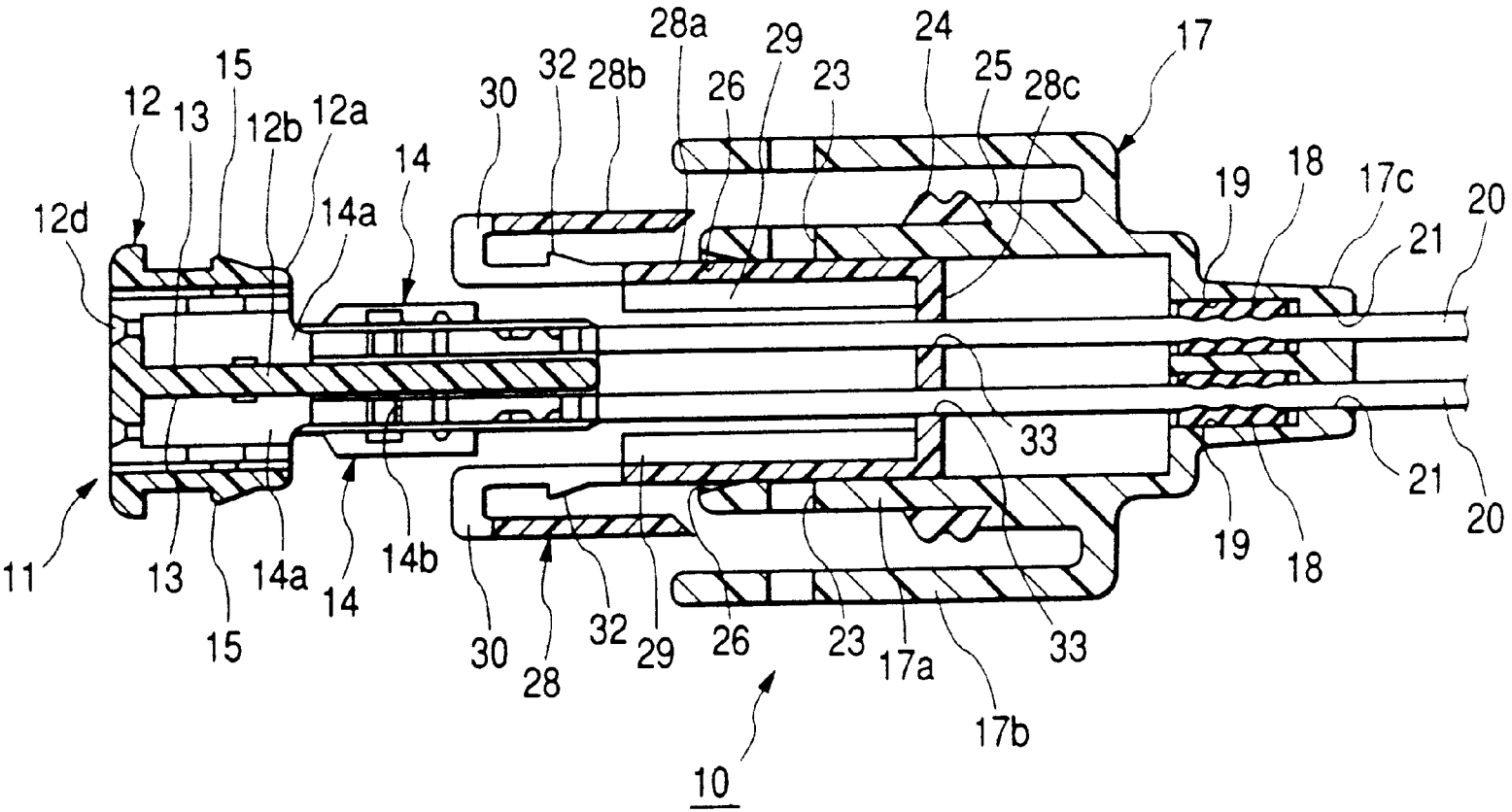
FIG. 6 PRIOR ART
FIG. 6 is a cross-sectional view of a related waterproof connector, showing a state before this connector is assembled.
Figure 7:
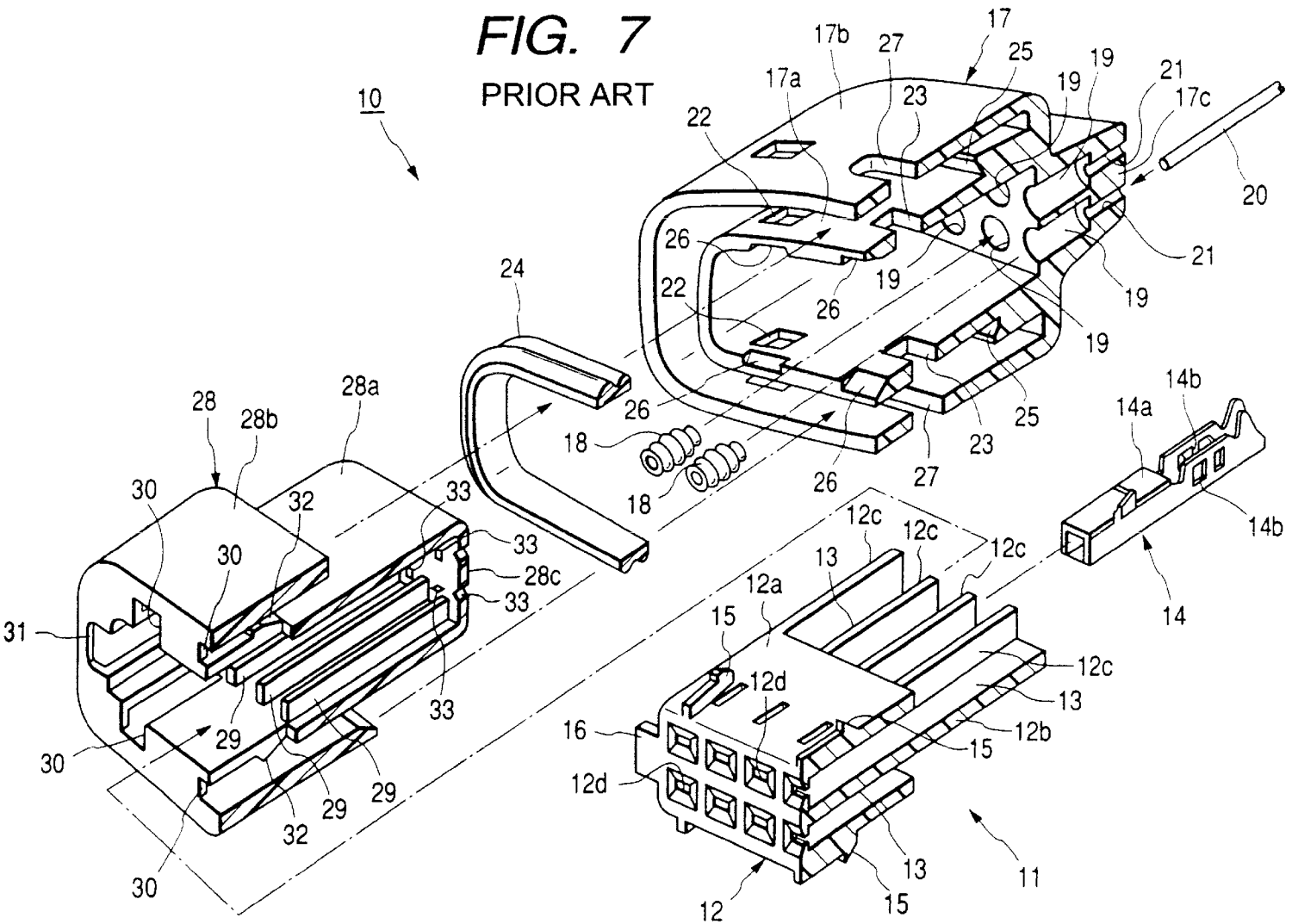
FIG. 7 PRIOR ART
FIG. 7 is a Partly ross-sectional, perspective view of the related waterproof connector, showing a state in which this connector is assembled.
Figure 8A:
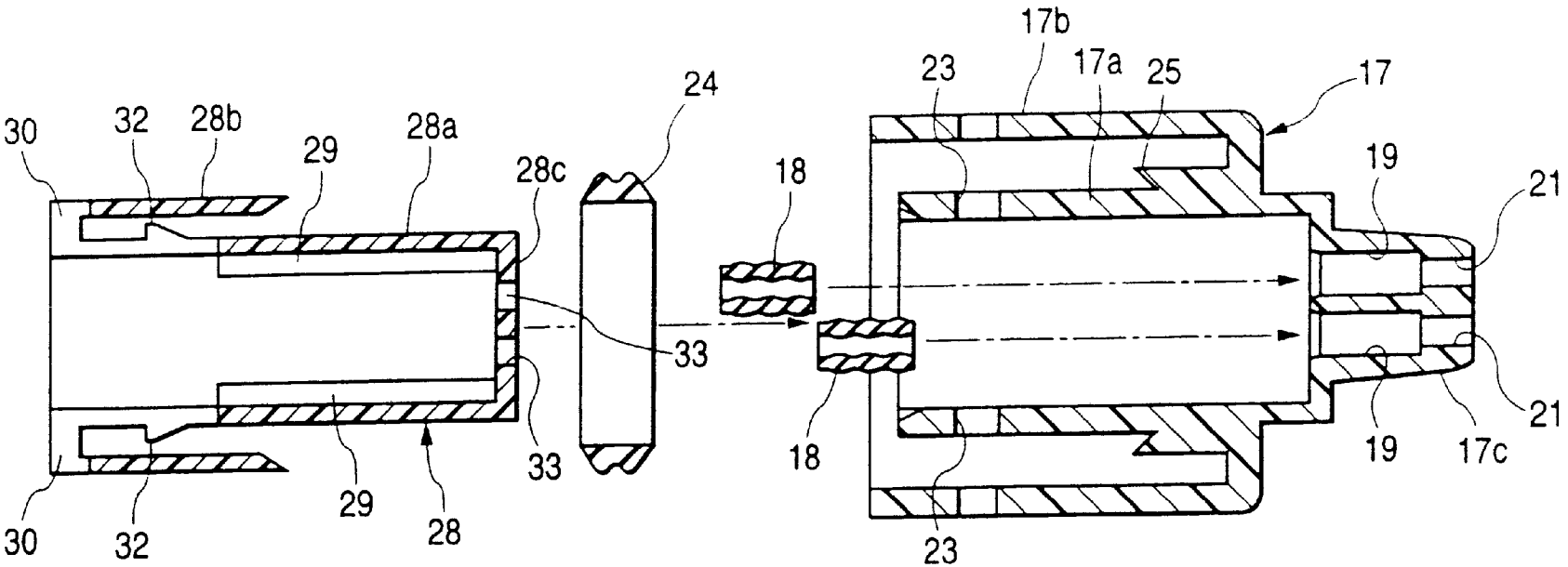
FIG. 8A PRIOR ART
FIG. 8A is a cross-sectional view showing a state before the related waterproof connector is assembled.
Figure 8B:
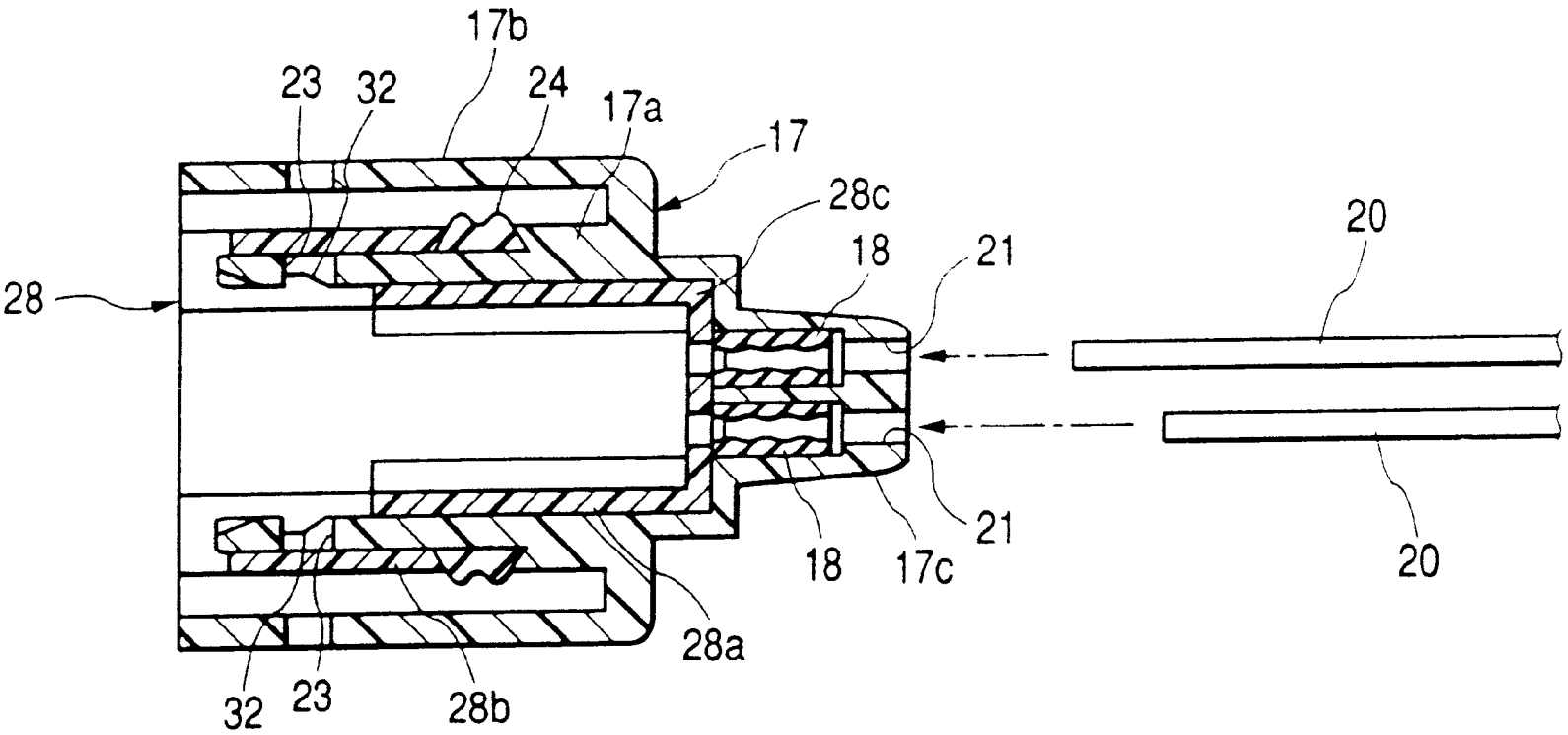
FIG. 8B PRIOR ART
FIG. 8B is a cross-sectional view showing a state in which a spacer is fitted in an outer housing of the related waterproof connector.
Figure 8C:
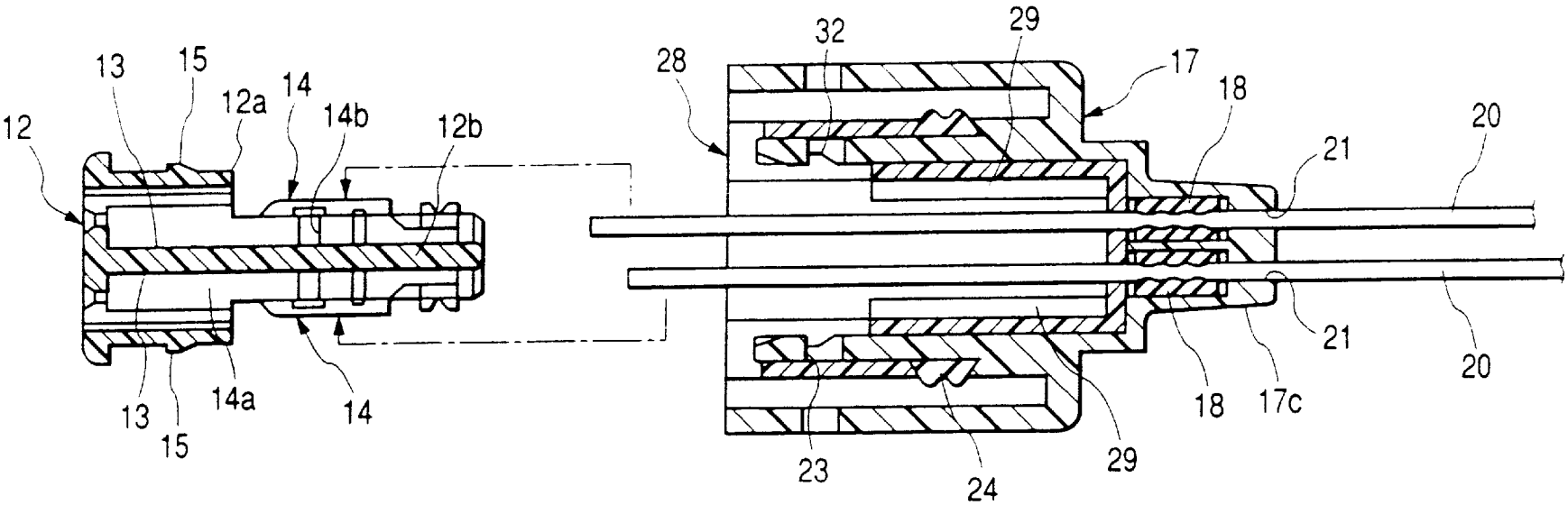
FIG. 8C PRIOR ART
FIG. 8C is a cross-sectional view showing a state in which wires are passed through the outer housing and the spacer.
Figure 8D:
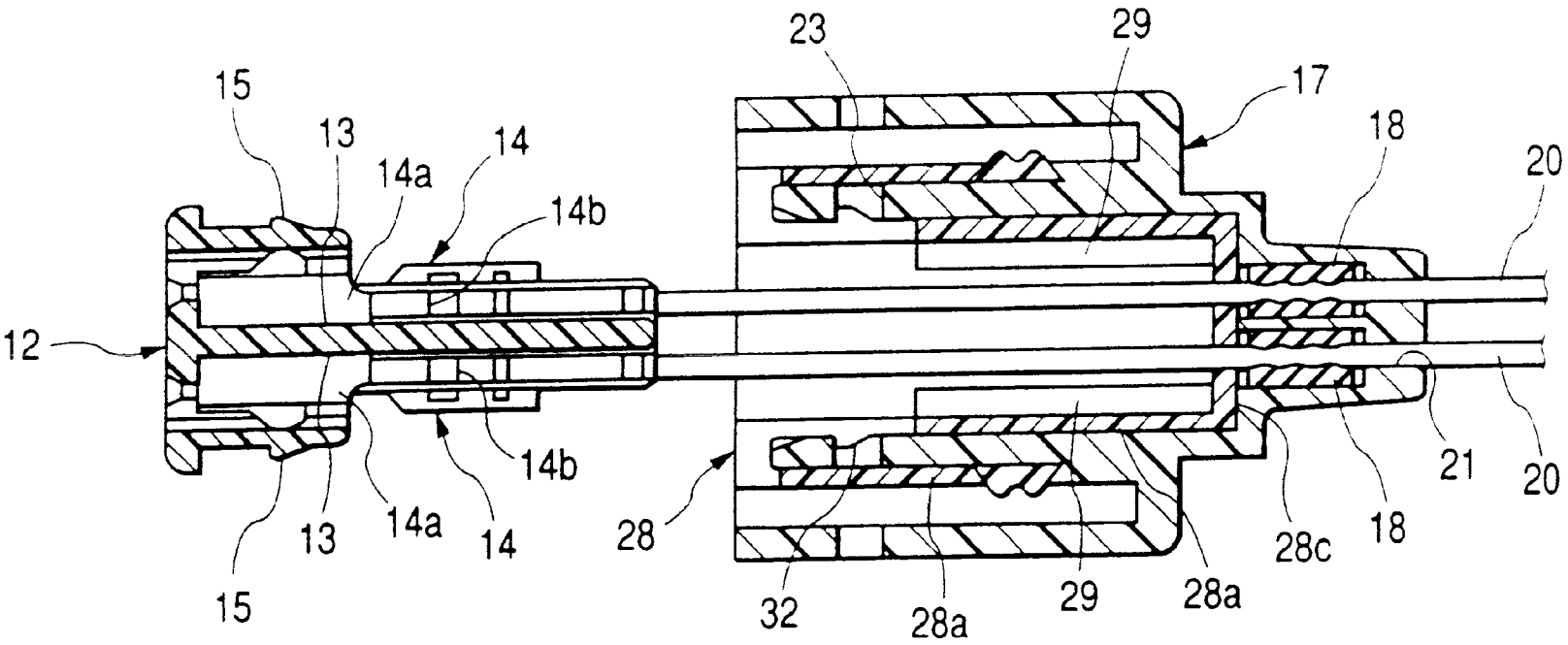
FIG. 8D PRIOR ART
FIG. 8D is a cross-sectional view showing a state in which the wires are connected respectively to terminals received respectively in terminal chambers in an inner housing.
Figure 8E:
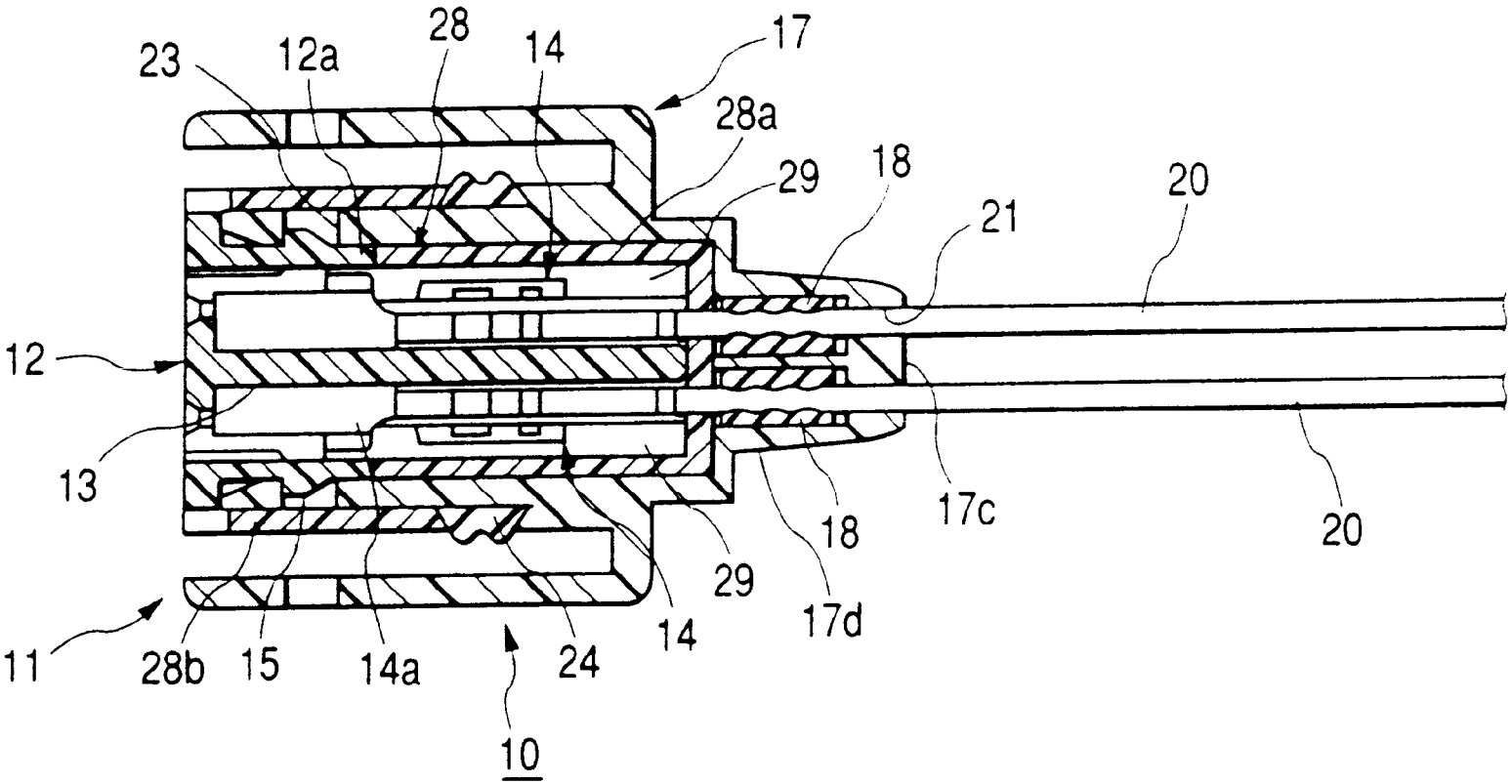
FIG. 8E PRIOR ART
FIG. 8E is a cross-sectional view of the related waterproof connector showing a state this connector is assembled.
Figure 9:
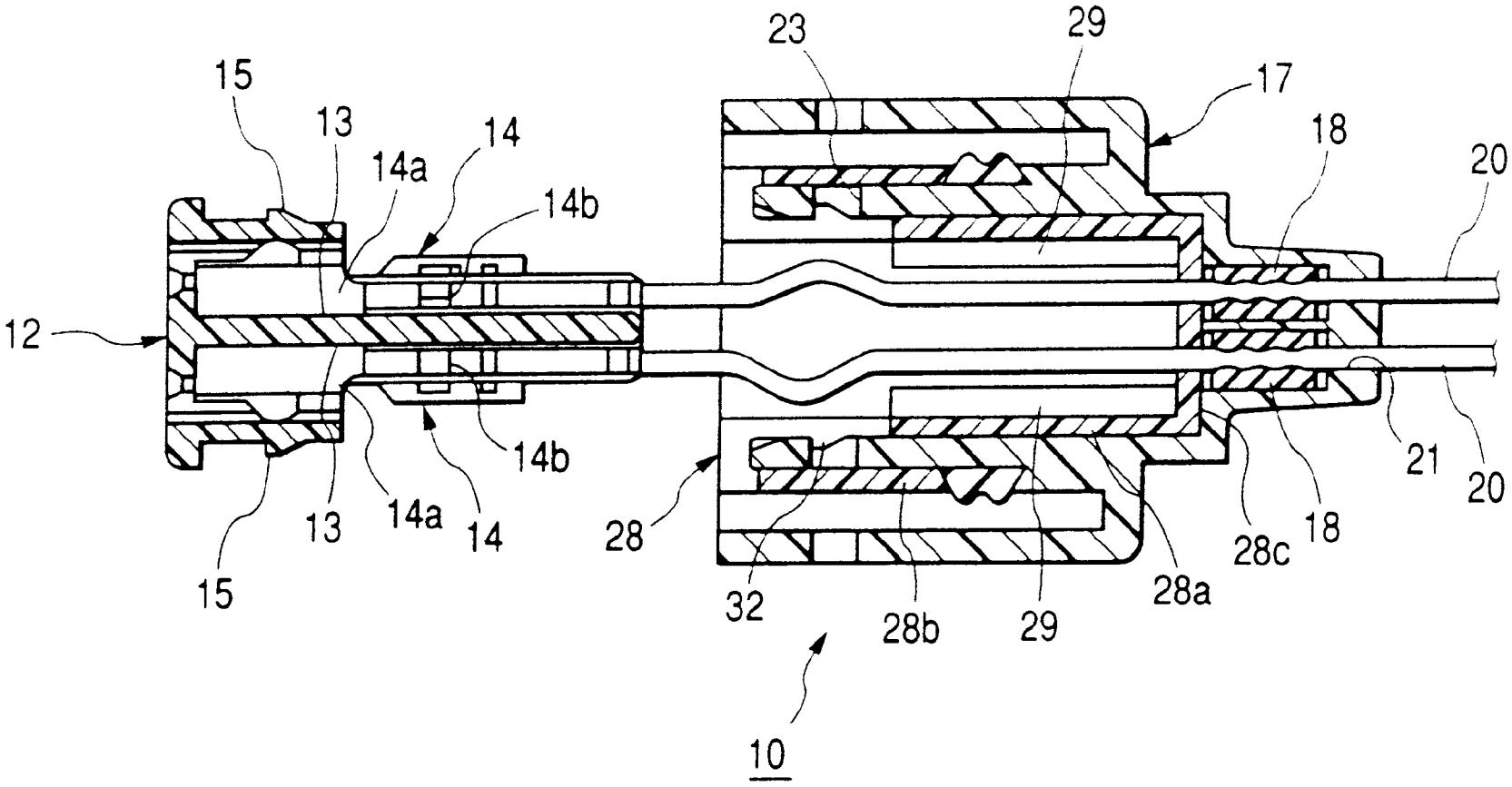
FIG. 9 PRIOR ART
FIG. 9 is a cross-sectional view of the related waterproof connector showing a state before the inner housing is fitted into the spacer fitted in the outer housing.

FIG. 1 is a cross-sectional view of one preferred embodiment of a waterproof connector of the invention, showing a state before this connector is assembled, FIG. 2 is a cross-sectional view of a rear holder used in the waterproof connector, showing a state before rubber plugs are integrally molded in the rear holder, FIG. 3 is a cross-sectional view of the rear holder, showing a state in which the rubber plugs are integrally molded in the rear holder, FIG. 4 is a rear view of the rear holder, and FIG. 5 is a cross-sectional view of the waterproof connector in an assembled state.

As shown in FIGS. 1 and 5, a connector housing 2 of the waterproof connector 1 is made of synthetic resin, and has a substantially square tubular shape having open front and rear ends. A front portion of the connector housing 2 is formed into a hood portion 3 for fitting on a mating connector (not shown). A plurality of terminal chambers 4 of a substantially square tubular shape are formed in a central portion of the connector housing 2, and are arranged in three rows and two columns. Plug chambers 5 of a cylindrical shape are formed in a rear portion of the connector housing 2, and communicate with the terminal chambers 4, respectively. The rear holder 6 (described later), made of synthetic resin, can be fitted on the outer peripheral face of that portion of the connector housing 2 having the plug chambers 5.

Retaining pawls 3*a* for being releasably engaged respectively in retaining holes in the mating connector (not shown) are integrally formed on and project from an upper face of the hood portion 3 of the connector housing 2. A lance 4*a* for retaining a female terminal 9 (described later), connected to a wire 8, is integrally formed on a and projects from a bottom of each terminal chamber 4 of the connector housing 2 at a central portion thereof. An annular rib 5*a*, also serving as a partition wall, is integrally formed at the boundary between each terminal chamber 4 and the corresponding plug chamber 5 in the connector housing 2. Retaining pawls 5*b* are integrally formed on and project from each of the upper and lower faces of that portion of the connector housing 2 having the plug chambers 5.

As shown in FIGS. 1 to 5, the rear holder 6 is made of synthetic resin, and has a generally box-shape having a closed bottom, and a plurality of wire insertion holes 6*b* of a large diameter are formed through a bottom wall portion 6*a* of this rear holder, and are arranged in three rows and two columns. Grooves 6*c* are formed in an outer face of the bottom wall portion 6*a* of the rear holder 6, and communicate the wire insertion holes 6*b* with one another to interconnect the wire insertion holes 6*b*. Retaining holes 6*e* are formed respectively through those portions of a peripheral wall 6*d* of the rear holder 6 corresponding respectively to the retaining pawls 5*b* formed on that portion of the connector housing 2 having the plug chambers 5, and the retaining pawls 5*b* can be releasably engaged in the retaining holes 6*e*, respectively.

As shown in FIGS. 3 and 4, the rubber plugs 7 are integrally formed respectively in the wire insertion holes 6*b* in the rear holder 6, and project from the inner face of the bottom wall portion 6*a* of the rear holder 6. Each of the rubber plugs 7 has a wire insertion hole 7*a* having an inner diameter B larger than an outer diameter D of the wire 8. Namely, after the rear holder 6 is formed by molding, rubber molding dies (not shown) are located respectively on the inner and outer sides of th s rear holder 6, and then molten rubber (not shown) is poured into cavities in this rubber molding die, thereby integrally forming the plurality of rubber plus 7 on the rear holder 6 in a projected manner. In FIGS. 3 and 4, reference character N denotes a rubber material pouring port, and reference character M denotes a degassing port. At this time, proximal ends 7*b*of the rubber plugs 7 are integrally formed with one another in an interconnecting manner via the grooves 6*c* which are formed in the outer face of the bottom wall portion 6*a* of the rear holder 6, and communicate the wire insertion holes 6*b* with one another. These interconnecting portions are designated by reference numeral 7*c*.

The inner diameter B of the wire insertion hole 7*a*, formed through each rubber plug 7 to be received in the plug chamber 5 in the connector housing 2, is larger than the outer diameter D of the wire 8 (B>D), and an outer peripheral face of a sealing portion 7*d* of the rubber plug 7 is corrugated. As shown in FIG. 3, the relevant portions are formed such that the relation, A<C−B+D is satisfied where A represents the inner diameter of each plug chamber 5 in the connector housing, B represents the inner diameter of the wire insertion hole 7*a* in each rubber plug 7, C represents the outer diameter of the sealing portion 7*d* of the rubber plug 7, and D represents the outer diameter of the wire 8.

As shown in FIG. 3, the distance E from the rear end of the retaining hole 6*e* in the rear holder 6 to the distal end of the sealing portion 7*d* of the rubber plug 7 is larger than the distance F from each rib 5*a* on the connector housing 2 to the retaining pawl 5*b* (E>F). With this configuration, when the rear holder 6, having the plurality of rubber plugs 7 formed integrally therewith, is fitted on that portion of the connector housing 2 having the plug chambers 5, the sealing portion 7*d* of each rubber plug 7 is compressed by the corresponding rib 5*a* (also serving as the partition wall) which forms part of the corresponding terminal chamber 4, and also forms part of the corresponding plug chamber 5. Therefore, when the rear holder 6 is attached to that portion of the connector housing 2 having the plug chambers 5, a positive seal is formed between each rubber plug 7 and the associated plug chamber 5, and also a positive seal is formed between the wire insertion hole 7*a* in each rubber plug 7 and the associated wire 8.

The female terminal 9 includes a box-like portion 9*a*, in which a male terminal in the mating connector can be inserted to contact the same, and a pair of wire connecting parts 9*b* and 9*b* which are formed integrally at a rear end of the box-like portion 9*a* so as to be connected to the wire 8 in a clamping manner. When each female terminal 9 is received in the associated terminal chamber 4 in the connector housing 2, the rear end of the box-like portion 9*a* of the female terminal 9. is retained By the lance 4*a*.

For assembling the waterproof connector 1 of this embodiment, the wires 8 are passed respectively through the wire insertion holes 7*a* of the rubber plugs 7, formed integrally with the rear holder 6, from the outer side thereof, as shown in FIG. 3. Th en, the pair of wire connecting parts 9*b* of each female terminal 9 are clamped and connected to the end portion of the associated wire 8 by pressing or the like, as shown in FIG. 1.

Then, the female terminals 9, connected respectively to the wires 8, are inserted respectively into the terminal chambers 4 in the connector housing 2 as indicated by arrows in FIG. 1, and are retained by the lances 4*a*, respectively. Then, the rear holder 6 is fitted on that portion of the connector housing 2 having the plug chambers 5, and the retaining pawls 5*b* on the connector housing 2 are retaining engaged respectively in the retaining holes 6*e* in the rear holder 6. As a result, the rubber plugs 7 are received respectively in the plug chambers 5 in the connector housing 2 in a compressed condition. Thus, the assembling operation of the water roof connector 1, in which the wires 8 are sealed by the rubber plugs 7, respectively, is completed.

As described above, the rear holder 6 can be releasably attached to (that is, fitted on) that portion of the connector housing 2 having the plug chambers 5, and the plurality of rubber plugs 7, each having the wire insertion hole 7*a* whose inner diameter B is larger than the outer diameter D of the wire 8, are formed integrally with the rear holder 6 in a projected manner, and the relevant portions are formed such that the relation, A<C−B+D is satisfied where A represents the inner diameter of each plug chamber 5, B represents the inner diameter of the ire insertion hole 7*a* in each rubber plug 7, C represents the outer diameter of the sealing portion 7*d* of the rubber plug 7, and D represents the outer diameter of the wire 8. Therefore, in the assembling operation in which each wire 8 is passed through the wire insertion hole 7*a* in the associated rubber plug 7, and then each female terminal 9 is connected to the end portion of the associated wire 8, and is received in the associated terminal chamber 4 in the connector housing 2, and then the rear holder 6 is fitted on that portion of the connector housing 2 having the plug chambers 5, the passing and sealing abilities of each wire 8 relative to the wire insertion hole 7*a* of the rubber plug 7 are good, and therefore each wire 8 is prevented from being buckled, thus enhancing the efficiency of the assembling operation of the waterproof connector 1 as well as the waterproof performance thereof. Therefore, a wire harness, comprising a bundle of wires 8, can be easily produced.

And besides, the sealing portion 7*d* of each rubber plug 7 can be compressed by the rib 5*a* (forming part of the plug chamber 5) when the rear holder 6, having the rubber plugs 7 formed integrally therewith, is attached to that portion of the connect or housing 2 having the plug chambers 5, and therefore a failure to attach the rubber plugs 7 can be detected easily and positively, and in addition a seal between each rubber plug 7 and the associated plug chamber 5 in the connector housing 2, as well as a seal between each rubber plug 7 and the 2 associated wire 8, can be formed easily and positively, thus enhancing the sealing performance.

Furthermore, the proximal ends 7*b* of the rubber plugs 7 are integrally formed with one another in an interconnecting manner via the channel-shaped grooves 6*c* which are formed in the outer face of the bottom wall portion 6*a* of the rear holder 6, and Communicate the wire insertion holes 6*b* with one another. Therefore, the plurality of rubber plugs 7 can be firmly secured to the bottom wall portion 6*a* of the rear h older 6, and the rubber plugs 6 will not be disengaged from the respective wire insertion holes 6*b* of a large diameter, formed in the bottom wall portion 6*a* of the rear holder 6, even when passing the wires 8 respectively through the wire insertion holes 7*a* of the rubber plugs 7 from the outer side. Therefore, the multi-way waterproof connector 1, having the excellent sealing performance, can be easily assembled in a short time, and the efficiency of the overall assembling operation can be further enhanced. Namely, the wire harness, comprising a bundle of wires 8, can be produced easily, and the efficiency of the overall assembling operation is further enhanced.

In the above embodiment, although each wire is clamped and connected to the crimp-type terminal, the terminals are not limited to the crimp-type, and the above embodiment can be applied to the case where each wire is press-connected to a press-connecting terminal.

What is claimed is:

1. A waterproof connecter comprising:

a connector housing including a terminal chamber for accommodating a terminal to which an electric wire is connected;

a rear holder attached to a rare end portion of the connector housing;

a waterproof rubber plug having through hole through which the electric wire is inserted, one end of which is configured as a cylindrical sealing portion, the other end of which is configured as a proximal end portion integrally provided with a rear end wall of the rear holder; and a plug chamber formed in the rear end portion of the connector housing so as to communicate with the terminal chamber for accommodating the rubber plug therein when the rear holder is attached with the connector housing, wherein the dimension of the plug chamber is determined such that a distal end of the sealing portion of the rubber plug is compressed in the attaching direction by an inner wall of the plug chamber when the rear hole is attached with the connector housing.

2. The waterproof connector as set forth in claim 1, wherein the dimension of the plug chamber is so determined as to satisfy the following relationship:

$$A<C-B+D$$

where A is an inner diameter of the plug chamber; B is an inner diameter of the through hole of the rubber plug; C is an outer diameter of the sealing portion of the rubber plug; and D is an outer diameter of the electric wire.

3. The waterproof connector as set forth in claim 1, wherein the connector housing includes a plurality of terminal chambers and the rear holder includes a plurality of waterproof rubber plugs associated with the terminal chambers respectively; and wherein the effective proximal ends of the rubber plugs are exposed to an outer face of the ear end wall of the rear holder and connected with each other via a groove formed on the outer face of the rear holder.

* * * * *